US007357391B2

(12) United States Patent
Landwehr

(10) Patent No.: US 7,357,391 B2
(45) Date of Patent: Apr. 15, 2008

(54) DEVICE FOR SELECTIVELY STACKING SHEETS

(75) Inventor: Martin Landwehr, Paderborn (DE)

(73) Assignee: Wincor Nixdorf International GmbH (DE)

( * ) Notice: Subject to any disclaimer, the term of this patent is extended or adjusted under 35 U.S.C. 154(b) by 234 days.

(21) Appl. No.: 10/559,037

(22) PCT Filed: Jul. 3, 2004

(86) PCT No.: PCT/DE2004/001421

§ 371 (c)(1),
(2), (4) Date: Nov. 30, 2005

(87) PCT Pub. No.: WO2005/005294

PCT Pub. Date: Jan. 20, 2005

(65) Prior Publication Data

US 2006/0119027 A1 Jun. 8, 2006

(30) Foreign Application Priority Data

Jul. 9, 2003 (DE) ..... 103 31 018

(51) Int. Cl.
*B65H 39/10* (2006.01)

(52) U.S. Cl. ..... 271/287; 271/296; 271/302; 271/177; 271/180; 271/220

(58) Field of Classification Search ..... 271/287, 271/296, 298, 302, 177, 180, 220, 67, 73
See application file for complete search history.

(56) References Cited

U.S. PATENT DOCUMENTS

| | | | | |
|---|---|---|---|---|
| 4,807,866 | A * | 2/1989 | Stemmle | 271/209 |
| 4,958,827 | A | 9/1990 | Kaneko | |
| 5,139,149 | A * | 8/1992 | Gerlier | 209/534 |
| 5,192,066 | A | 3/1993 | Steinhilber | |
| 5,282,612 | A | 2/1994 | Gerlier | |
| 5,803,227 | A | 9/1998 | Stein et al. | |
| 6,199,856 | B1 * | 3/2001 | Clauser et al. | 271/180 |
| 6,953,191 | B2 * | 10/2005 | Landwehr et al. | 271/177 |
| 2004/0051235 | A1 * | 3/2004 | Landwehr et al. | 271/177 |

FOREIGN PATENT DOCUMENTS

| | | |
|---|---|---|
| DE | 37 09 726 C2 | 3/1987 |
| DE | 101 05 242 C1 | 7/2002 |
| EP | 0 470 329 A | 2/1992 |
| EP | 0 747 866 A | 12/1996 |

* cited by examiner

*Primary Examiner*—David H Bollinger
(74) *Attorney, Agent, or Firm*—Harness, Dickey & Pierce, P.L.C.

(57) ABSTRACT

A device (10) for stacking sheets and a device for depositing notes, which comprises a plurality of such devices (10), are shown. The device (10) comprises at least one carrying face (16, 18) for carrying a sheet stack, the carrying face itself or the surface of a sheet stack located on it forming a stack face for depositing the sheets. It comprises, furthermore, a roll-on device with a first roller (30) which can be adjusted transversely with respect to its longitudinal axis along an adjustment path which is directed parallel with respect to the stack face, and with at least one first belt (26) which is led from above around the first roller and, parallel with respect to the stack face, to a first fastening point (28) in the region of one end of the adjustment path, at which fastening point said first belt is secured, the stack face (16) being pressed from below against the at least one first belt (26) in order to retain the sheet stack. Finally, the device (10) comprises a sheet supply device which is suitable for transporting a sheet with an edge toward one end of the stack face, from which end it is rolled onto the stack face in the direction of the other end of the latter, the sheet supply device being adjustable along the adjustment path between a first position, in which it can transport the sheet (80) with the edge (82) toward one end of the stack face (24), and at least one further position, in which it can lead the sheet (80) with the edge (82) toward one end of a further stack face (24) or into a transport device (76) for the further transport of the sheet (80).

16 Claims, 5 Drawing Sheets

DEVICE FOR SELECTIVELY STACKING SHEETS

Figure 1:
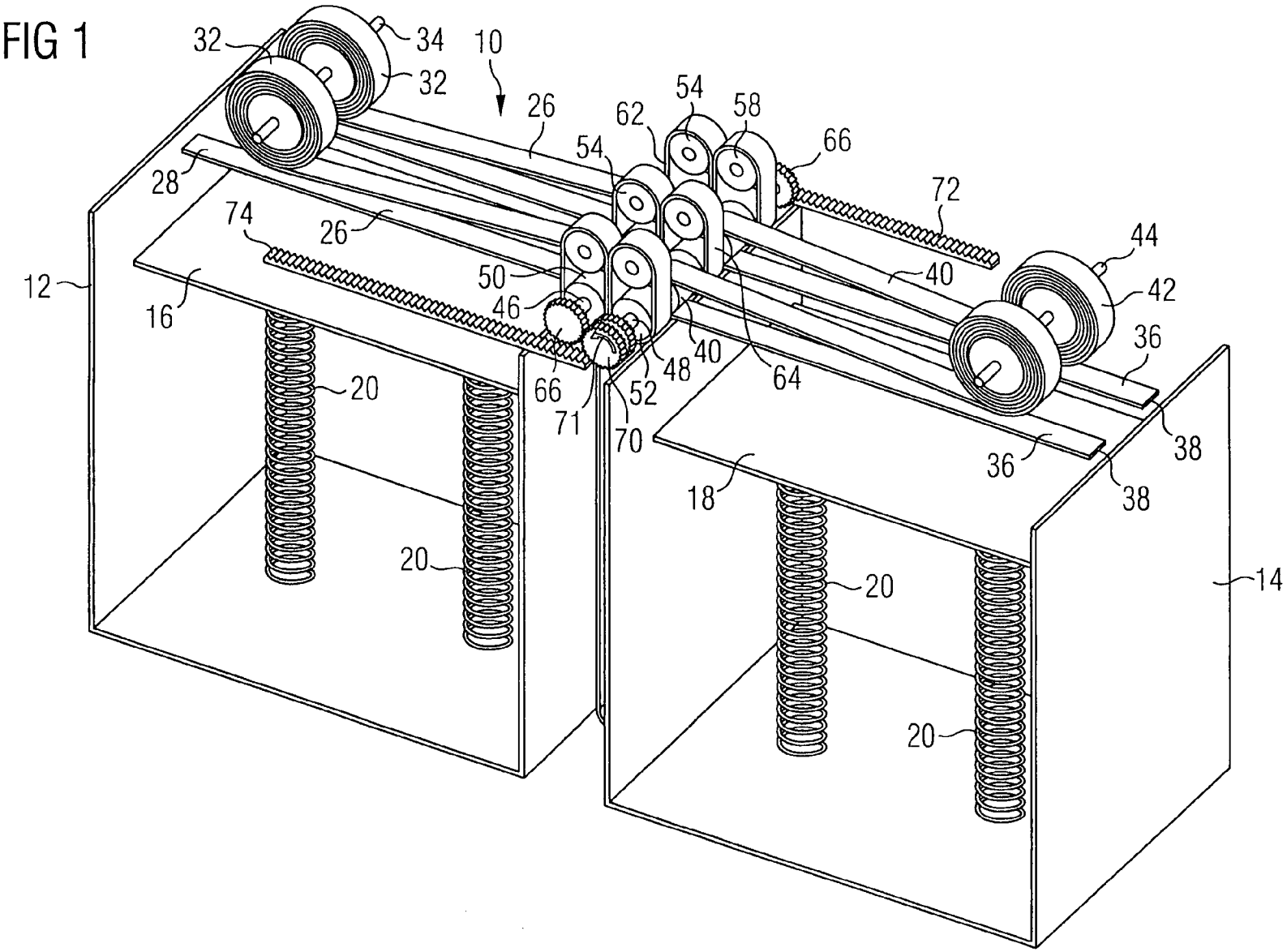

The present invention relates to a device for selectively stacking sheets, in particular banknotes or check forms, according to the preamble of claim 1.

A device of this type comprises at least one carrying face for carrying a sheet stack, the carrying face itself or the surface of a sheet stack located on it forming a stack face for depositing the sheets. It comprises, furthermore, a roll-on device with a first roller which can be adjusted transversely with respect to its longitudinal axis along an adjustment path, and with at least one first belt which is led from above around the first roller and, parallel with respect to the stack face, to a first fastening point in the region of one end of the adjustment path, at which fastening point said first belt is secured, the stack face being pressed from below onto the at least one first belt in order to retain the sheet stack. Finally, the device comprises a sheet supply device which is suitable for transporting a sheet with an edge toward one end of the stack face, from which end it is rolled onto the stack face in the direction of the other end of the latter.

The invention relates, furthermore, to a device for depositing notes.

The term "at least one" first belt refers to the fact that, instead of a single first belt, in particular, a group of a plurality of first belts may be used, which are arranged parallel with respect to one another and are guided in the same way.

Devices of the type initially mentioned are known from DE 101 05 242 C1, EP 0 470 329 A1 and EP 0 747 866 B1. In these known devices, the sheets are rolled by the first roller, by means of the at least one first belt led around the latter, in the direction of the other end of the stack face, in that the sheets are transported with an edge toward one end of the stack face, and then the first roller is rolled along the adjustment path from the first end of the stack face in the direction of the second end of the stack face, the at least one first belt laid around the first roller being rolled off on the stack face, and thereby the sheet stack, which is pressed against the first belt from below by springs, being retained.

In DE 101 05 242 C1 and EP 0 747 866 B1, the sheet supply device is formed by at least one pair of transport rollers, between the outer surface areas of which is formed a roller nip through which the sheets are led. The pair of transport rollers is arranged in such a way that a sheet led through the roller nip is guided with an edge toward one end of the stack face.

In EP 0 470 329 A1, the carrying face for carrying the sheet stack is arranged vertically adjustably in a housing.

The first roller is fastened to a slide adjustable along the adjustment path. The first belt is secured to the housing near one end of the stack face and is led from there around the first roller, over a row of fixed deflecting rollers and through under the housing to a second roller likewise fastened to the slide, around said second roller and to a further fastening point near the other end of the stack face. Furthermore, between the first and the second roller is located a third roller which is parallel with respect to these and over which runs an endless belt which is tensioned via two further deflecting rollers and, together with the first belt, forms a belt transport which transports a sheet guided between the two belts with an edge toward one end of the stack face. In this embodiment, therefore, the sheet supply device is formed by a belt transport, one belt of which is formed by the at least one first belt.

In practice, a plurality of devices of the type initially mentioned are often used in one appliance. For example, in automatic cash depositing machines, a plurality of devices of a type initially mentioned are typically used in order to deposit notes or check forms in stack form in various boxes. Generally, for each sheet stack to be formed, that is to say for each of the boxes present, one of these devices is required, that is to say each sheet stack to be formed is assigned its own roll-on device and its own sheet supply device. Furthermore, at least one distributing guide in a sheet transport of the appliance is usually provided for each sheet stack to be formed, a sheet being supplied to the associated sheet supply device via said distributing guide. This multiplicity of components required leads to high costs and to a high space requirement.

EP 0 470 329 A1 gives an exemplary embodiment in which two sheet stacks are arranged one behind the other along the adjustment path of the first roller, so that two sheet stacks can be formed, using only one roll-on device and only one sheet supply device. The special type of roll-on device of EP 0 470 329 A1 makes it possible to deposit a sheet on one stack or the other by suitable selection of the time point at which it is introduced into the sheet supply device.

However, the roll-on device in EP 0 470 329 A1 is relatively complicated and space-consuming and, if only for those reasons, is not advantageous. Furthermore, an essential disadvantage is that, if a roll-on and supply device is to be used jointly for two sheet stacks to be formed, the first belt has to be led through under both sheet stacks and therefore prohibits a vertical transport of sheets between the two sheet stacks, thus signifying a considerable restriction in the construction of an appliance having a plurality of such roll-on devices.

The object on which the present invention is based is to specify a device of the type initially mentioned which solves at least the problems mentioned.

This object is achieved, according to the invention, in that the supply device, having a sheet held in it, can be adjusted along the adjustment path between a first position, in which it can transport the sheet with the edge toward one end of the stack face, and at least one further position, in which it can guide the sheet with the edge toward one end of a further stack face or into a transport device for the further transport of the sheet.

As compared with the devices of DE 101 05 242 C1 and EP 0 747 866 B1, the stationary supply devices of which are intended solely for the supply of sheets to exactly one stack face, the supply device of the invention thus has an at least twofold function. In addition to the conventional function of supply to a stack face, the adjustable supply device of the device according to the invention can guide the sheet held in it to a further stack face, thus corresponding to a sorting function, or can guide it into a transport device for further transport, with the result that a branching in the transport path is implemented.

In both instances, as compared with conventional devices, there is no need for a distributing guide, such as is normally required for sorting functions or branchings. Moreover, in the former case, as compared with conventional devices, there is no need for a supply device, because one supply device in this case serves for supplying sheets to two stack faces.

Although the device of EP 0 470 329 A1 likewise has a sorting function, this is nevertheless not achieved by means of an adjustable supply device, but, instead, by the selection of the time point at which the sheet is introduced into the stationary supply device. Moreover, a branching function by transfer to a transport device is neither provided nor is to be implemented in a simple way in EP 0 470 329 A1. A substantial problem with this case is that a belt of the supply device of EP 0 470 329 A1 surrounds said device to great extents and therefore obstructs further transport.

Preferably, the first roller and the supply device are fastened to a carriage or slide moveable along the adjustment path. The supply device then requires no additional drive for adjustment along the adjustment path.

Preferably, a plurality of carrying faces are arranged along the adjustment path, which each form a stack face for sheets.

Preferably, the device comprises, furthermore, a transport device which is arranged between two stack faces and to which a sheet can be transferred from the supply device when the supply device assumes a transfer position contained within the adjustment path.

In an advantageous development, the roll-on device comprises a second roller which is parallel to the first roller and which can be adjusted jointly with the first roller along the adjustment path, a roller nip is formed between the first and the second roller, the at least one first belt is led, starting from a first belt store, from above through the roller nip around the first roller, and at least one second belt is provided, which, starting from a second belt store, is led from above through the roller nip, around the second roller and, parallel with respect to the stack face, to a second fastening point in the region of the other end of the adjustment path, at which end said second belt is secured. By using at least one first and at least one second belt, the sheet stack is always held by at least one of the belts independently of the current position of the first and of the second roller.

Preferably, the first and the second belt stores are formed in each case by a storage roller, onto which the at least one first or the at least one second belt can be wound.

In an advantageous development, the storage rollers are mounted in each case on a winding shaft, one of the winding shafts is coupled to a drive motor and, via a gear, to the other winding shaft, and the storage rollers are prestressed into their respective winding position.

In a preferred embodiment, the supply device is formed by a belt transport. Preferably, in this case, the supply device has a third and a fourth roller, the axis of which is identical to the axis of the first and the second roller and around which are laid at least one third and at least one fourth belt which form transport belts for the belt transport. This developed device thereby becomes simple and compact as a whole.

Preferably, in this case, the diameter of the third and of the fourth roller is greater than the diameter of the first and of the second roller by at least so much that a sheet transported between the at least one third and the at least one fourth belt through the roller nip between the first and the second roller does not come into contact in the region of the roller nip with the at least one first and second belt. This is advantageous in order to avoid conflict in the direction of rotation of the in each case rolling-up first or second belt with the transport of the sheet in the belt transport of the sheet supply device, as is explained in more detail with reference to the exemplary embodiment described below.

Preferably, the third and the fourth roller are mounted fixedly in terms of rotation respectively on a first and a second shaft, and the first and the second roller are mounted freely rotatably respectively on the first and the second shaft. In this case, preferably, a driving gearwheel is mounted in each case on the first shaft and on the second shaft and is coupled to the respective shaft via a freewheel in such a way that each driving gearwheel can drive the associated shaft in only the direction of rotation which causes a supply of the sheet.

Furthermore, a coupling gearwheel is preferably mounted in each case on the first and on the second shaft, said coupling gearwheels being in engagement with one another. In an advantageous development, a fixed driving gearwheel is provided, which is in engagement with one of the driving gearwheels of the shafts when the supply device is in the transfer position. The fixed driving gearwheel is preferably coupled to the transport device. Furthermore, at least one rack is arranged along at least part of the adjustment path in such a way that one of the driving gearwheels comes into engagement with said rack when the associated shaft is moved along the adjustment path past the rack.

In this development, the supply device does not require its own drive, since, in the transfer position, it is driven by the transport device via the fixed driving gearwheel and, during adjustment, is driven along the adjustment path, that is to say, in particular, during the rolling on of a sheet, via the racks and one of the driving gearwheels mounted on the first and on the second shaft.

Figure 2:
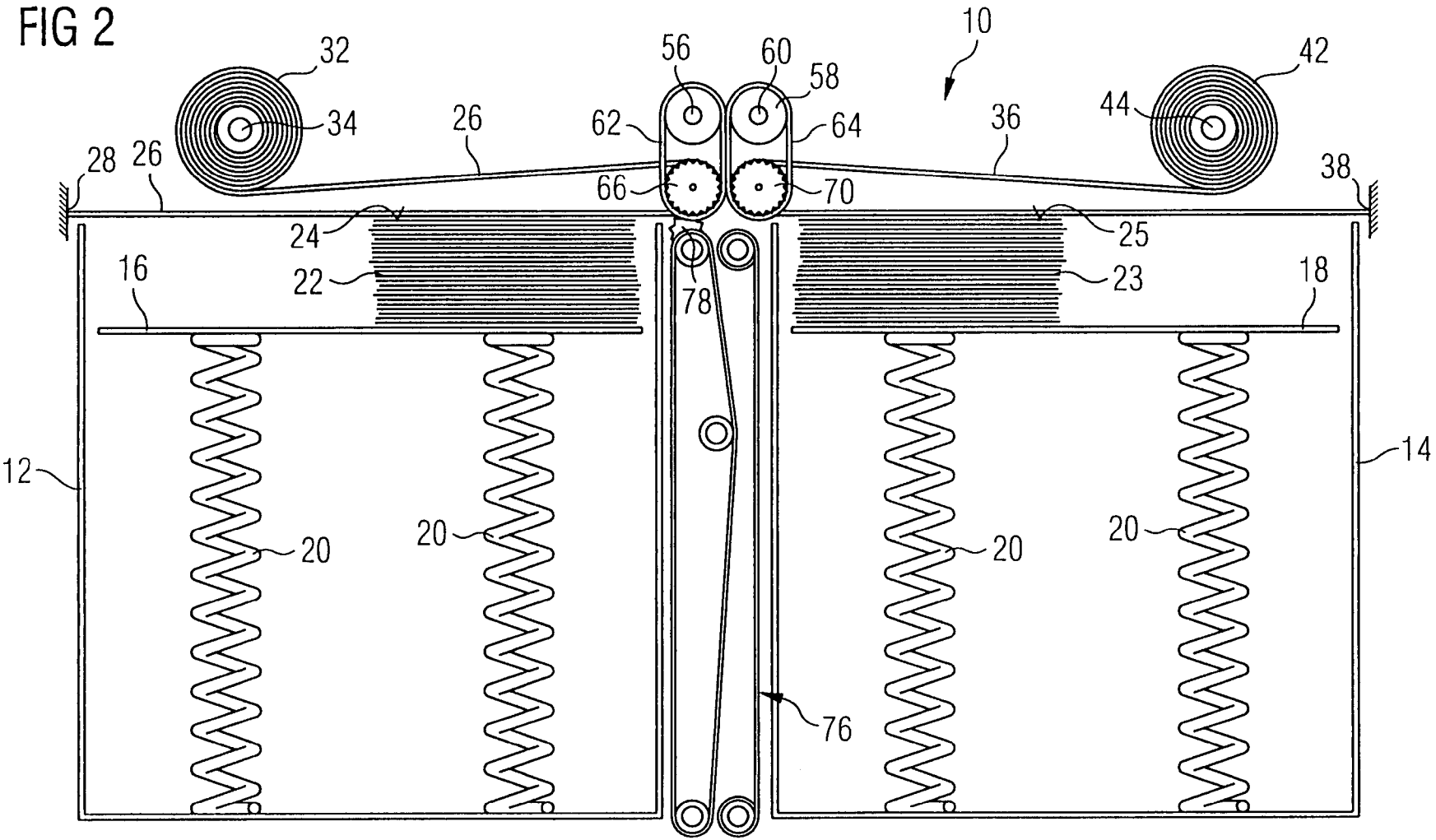
Figure 3:
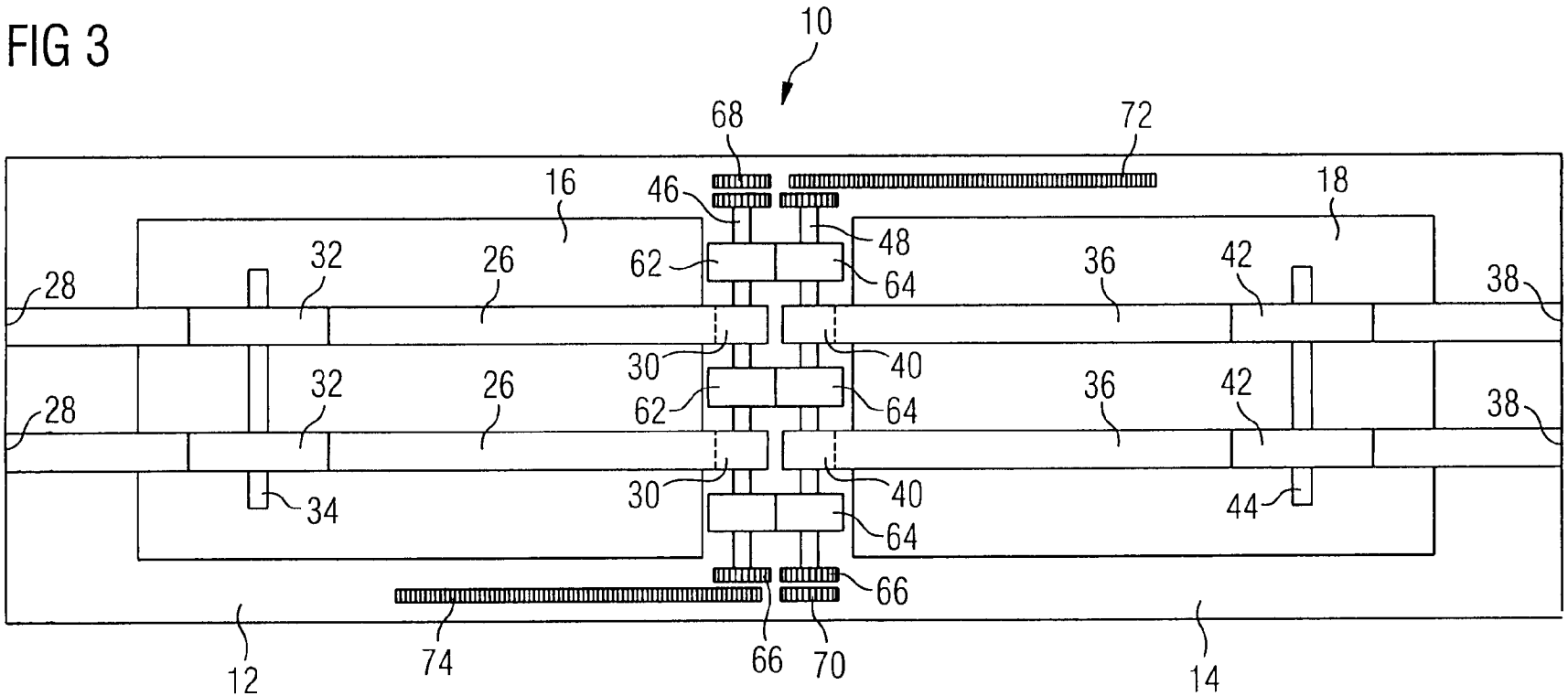
Figure 4:
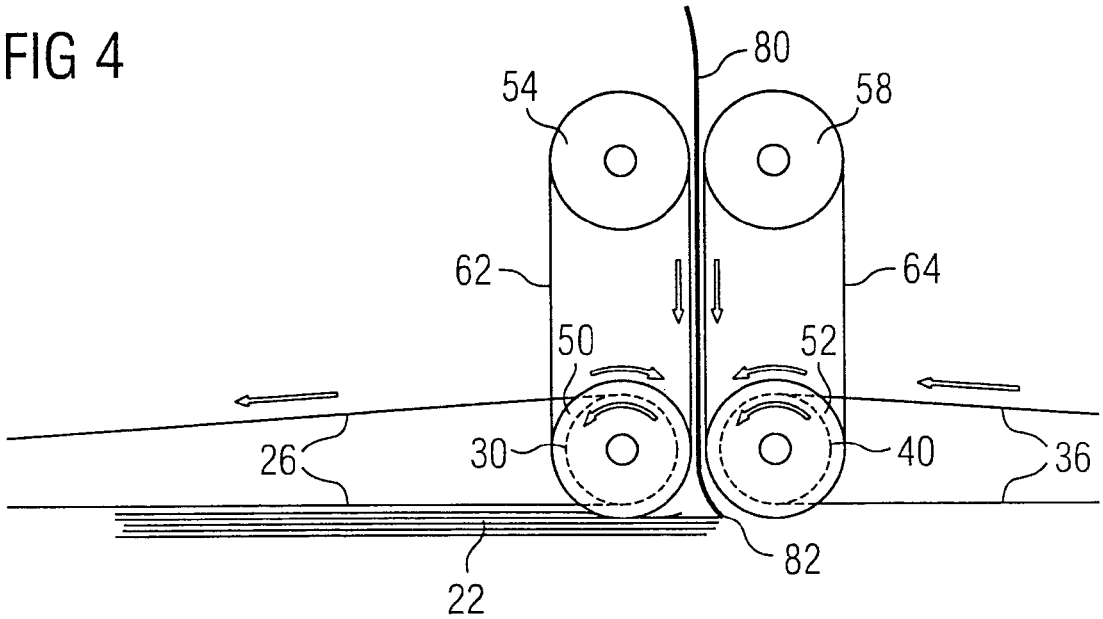
Figure 5:
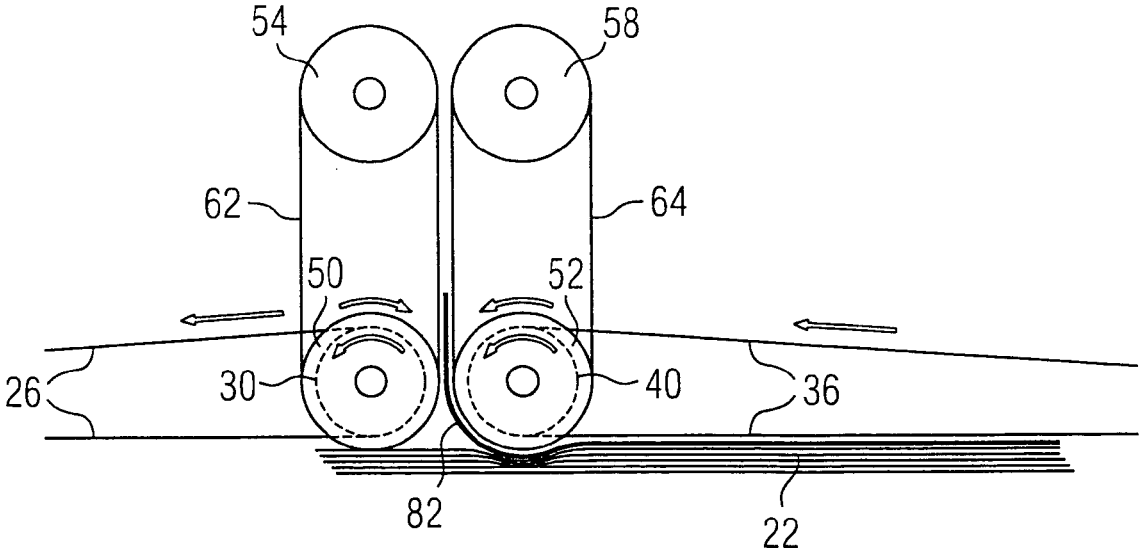
Figure 6:
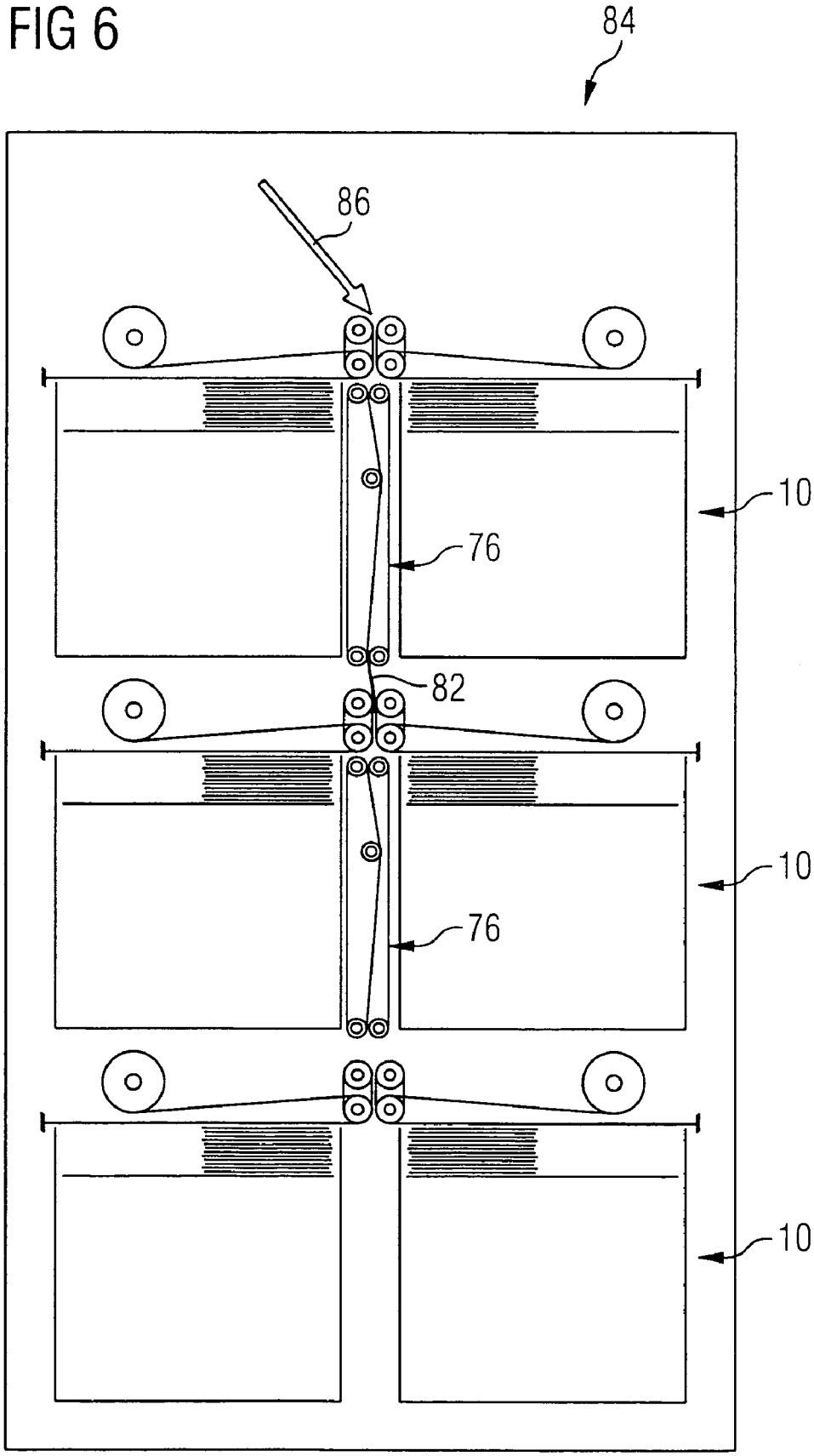

Further advantages and features of the solution according to the invention may be gathered from the following description which explains the invention by means of an exemplary embodiment in conjunction with the accompanying drawings in which:

FIG. 1 shows a perspective view of a device for stacking sheets according to a development of the invention, FIG. 2 shows a side view of the device of FIG. 1, FIG. 3 shows a top view of the device of FIG. 1, FIG. 4 shows a diagrammatic illustration of a supply device and of parts of a roll-on device at the commencement of the rolling of a banknote onto a banknote stack, FIG. 5 shows the elements of FIG. 4 shortly before rolling on is terminated, and FIG. 6 shows a diagrammatic illustration of a device for depositing notes.

FIG. 1 shows a simplified illustration of a device 10 for stacking sheets according to a development of the invention. FIG. 2 shows a simplified side view and FIG. 3 a simplified top view of the same device 10.

The device 10 serves for stacking banknotes in a box 12 or 14. In each of the boxes 12 and 14 is arranged a carrying face 16 and 18 prestressed upward by springs 20. The carrying faces 16 and 18 serve for carrying in each case a banknote stack 22 (see FIG. 2), said banknote stacks having been omitted in FIG. 1 and FIG. 3 for the sake of clarity. The surfaces of the banknote stacks 22 form in each case a stack face 24 on which further banknotes are to be deposited.

The device 10 comprises, furthermore, two first belts 26 which are secured at a fastening point 28 and are led from there, parallel with respect to the stack face 24, in each case to a first roller 30 (see FIG. 4, FIG. 5), around the latter from below and further on in each case to a first storage roller 32, said storage rollers being mounted on a first winding shaft 34. Two second belts 36 are secured in a similar way at fastening points 38, from which they are led, parallel with respect to the other stack face 24, in each case to a second roller 40, around the latter from below and further on in each case to a second storage roller 42, said storage rollers being mounted on a second winding shaft 44.

The first rollers 30 are mounted freely rotatably on a first shaft 46 and the second rollers 40 are mounted freely rotatably on a second shaft 48. The first and the second shaft 46, 48 are mounted jointly in a slide which is not shown in the figures for the sake of clarity. The slide can be moved along an adjustment path between the first storage roller 32 and the second storage roller 42.

The first and the second belt 26, 36, the slide with the first and the second shaft 46, 48 and with the first rollers 30 and second rollers 40 mounted on it, and also the first and the second storage roller 32, 42, form the essential elements of a roll-on device, such as has already been described in detail in DE 101 05 242 C1, so that more detailed particulars of this do not need to be explained here.

Furthermore, three third rollers 50 are mounted fixedly in terms of rotation on the first shaft 46, and three fourth rollers 52 are mounted fixedly in terms of rotation on the second shaft 48. Vertically above the third rollers 50 are located three fifth rollers 54 which are mounted freely rotatably on a third shaft 56 (see FIG. 2).

Both the third shaft 56 and the first and the second shaft 46, 48 are mounted in the slide (not shown). Said third shaft is omitted in FIG. 1 and FIG. 3 for the sake of clarity.

Vertically above the fourth rollers 52 are located three sixth rollers 58 which are mounted rotatably on a fourth shaft 60 which has likewise been omitted in FIG. 1 and FIG. 3. The fourth shaft 60 is likewise mounted in the slide (not shown).

A third belt 62 is laid around each of the third rollers 50 and the fifth roller 54 arranged in each case vertically above it, and a fourth belt 64 is laid around each of the fourth rollers 52 and the sixth roller 58 arranged in each case vertically above it. The third and the fourth belts 62, 64 are endless belts which jointly form a belt transport. This belt transport constitutes an embodiment of the sheet supply device mentioned initially.

Mounted at the two ends of the first and of the second shaft 46, 48 are coupling gearwheels 66 which engage one into the other and thus couple the first and the second shaft 46, 48 to one another.

The first driving gearwheel 68 (concealed in FIG. 1, see FIG. 3) is arranged at the rear end of the first shaft 46 in FIG. 1, a second driving gearwheel 70 is arranged at the front end of the second shaft 48 in the illustration of FIG. 1. The first and the second driving gearwheels 60, 70 are coupled respectively to the first and second shaft 46, 48 via a freewheel in such a way that they can drive the associated shaft 46 and 48 in only the direction of rotation which corresponds to a sheet supply, that is to say in the direction of rotation in which those portions of the third and fourth belt 62, 64 which lie against one another run from the top downward. This direction of rotation is indicated in FIG. 1 by the arrow 71 with regard to the second driving gearwheel 70.

As can be seen in FIGS. 1 and 3, along the adjustment path are arranged a first rack 72 and a second rack 74, into which the first and the second gearwheels 68, 70 engage respectively in a suitable position of the slide (not shown).

As can be seen in FIG. 2, a transport device 76, which is formed by a vertical belt transport, is arranged between the banknote boxes 12 and 14.

The functioning of the device 10 is described below. In FIG. 1,

FIG. 2 and FIG. 3, the slide (not shown) is in a middle position between the two banknote boxes 12 and 14. The slide itself is not shown in the figures, but only its components essential to describe functioning, to be precise the first and the second shaft 46, 48 together with the coupling gearwheels 66 and driving gearwheels 68 and 70 arranged on said shafts, the first and second rollers 30, 40 mounted freely rotatably on the first and the second shaft, and the sheet supply device which is formed from the third rollers 50, fourth rollers 52, fifth rollers 54, sixth rollers 58 and the third and fourth belts 62, 64.

In this middle position of the slide, the sheet supply device is in a transfer position, in which a banknote transported downward between the third and the fourth belt 62, 64 is transferred to the transport device 76 and is transported further on by the latter downward through between the boxes 12 and 14. In this transfer position of the supply device, a gearwheel 78 (see FIG. 2) engages on the first driving gearwheel 68 and thereby drives the transport belts of the supply device, that is to say the third and fourth belts 62, 64.

If a banknote is to be deposited on the banknote stack 22 in the box 12 on the left in the figures, at a predetermined time point, at which the leading edge of the banknote is located in the supply device approximately in the middle between the upper rollers (that is to say, the fifth and sixth roller 56, 58) and the lower rollers (that is to say, the third and fourth roller 50, 52), the first belt 26 begins to be wound up by the first winding shaft 34 being driven. The first winding shaft 34 and the second winding shaft 44 are coupled to one another via a toothed belt (not shown) in such a way that the second belt 36 is unwound simultaneously. In this case, the slide is drawn along the adjustment path in the direction of the left box 12 by the first belt 26.

As soon as the slide leaves this middle position, the fixed gearwheel 78 (FIG. 2) comes out of engagement with the first driving gearwheel 68. At the same time, the second driving gearwheel 70 comes into engagement with the second rack 74 (FIG. 1, FIG. 3) and is driven by the second rack 74 during the further adjustment of the slide. The second driving gearwheel 70, in turn, drives the second shaft 48 together with the fourth rollers 52 mounted fixedly in terms of rotation on the latter. At the same time, the first shaft 46, together with the third rollers 50 mounted fixedly in terms of rotation on it, is driven via the coupling gearwheels 66. Thus, overall, the supply device is driven by the movement of the slide, that is to say, ultimately, by the first belt 26 being wound up.

During the leftward movement of the slide, therefore, the banknote is transported vertically downward in the supply device, specifically in such a way that the banknote impinges with its leading edge on the right end of the banknote stack 22 in the left box 12 and subsequently, starting from the right end, is rolled on in the direction of the left end of the banknote stack 22.

FIGS. 4 and 5 show two snapshots during the rolling of the banknote onto the banknote stack 22.

The directions of rotation of the belts and the directions of rotation of the rollers are in this case indicated by the nearby arrows. FIG. 4 shows a snapshot at the commencement of rolling on. This shows a banknote 80 which is transported vertically downward between the third belt 62 and the fourth belt 64 and just impinges with its leading edge onto the right margin of the banknote stack 22. In this case, the leading edge 82 of the banknote 80 is caught on the banknote stack 22 when the slide is moved further to the left, so that, as shown in FIG. 4, the leading end of the banknote 80 is bent round and subsequently rolled onto the surface of the banknote stack 22 by the fourth rollers 52 and the second rollers 40. In this case, the second belt 36 is rolled off on the banknote 80, with the result that the banknote stack 22 is held.

In the illustration of FIG. 4, the first roller 30 and the second roller 40 are concealed respectively by the third roller 50 and the fourth roller 52 and are therefore depicted by broken lines. As can be seen in FIG. 4, the diameters of the third and of the fourth roller 50, 52 are somewhat greater than those of the first and of the second roller 30, 40. Whereas the outer surface areas of the third and fourth rollers 50, 52 lie so closely to one another that the third belt 62 and the fourth belt 64 lie snugly against one another, a somewhat larger roller nip is formed between the first roller 30 and the second roller 40. Owing to the smaller size of the first and of the second roller 30, 40, the first and the second belt 26, 36 do not come into contact with the banknote 80 in the region of the roller nip. This is important because, on account of the direction of rotation of the first roller 30, the first belt 26 would counteract the downward transport of the banknote 80 and the banknote 80 could possibly be upset. However, the size differences between the first and the second roller 30, 40, on the one hand, and of the third and of the fourth roller 50, 52 on the other hand, are illustrated, greatly exaggerated, in FIG. 4 for illustrative purposes. In practice, even a very small diameter difference is sufficient.

FIG. 5 shows a snapshot shortly before the rolling on of the banknote 80 is terminated. As can be seen in this, the banknote 80 is held on the banknote stack 22 by the second belt 36. The slide can subsequently be moved back into the middle position. In this case, the supply device is no longer driven, since the second driving gearwheel 70 has a free-wheel and does not transmit any torque to the second shaft 66 when the slide is being moved back.

A banknote is deposited on the banknote stack 22 of the right box 14 according to the same principle, except that, instead of the first belt 26, the second belt 36 is wound up on the associated second storage roller 42.

As became clear from the above description, the device 10 described serves not only for rolling banknotes onto banknote stacks, but also for sorted depositing which also affords the possibility of a vertical further transport of a banknote.

FIG. 6 shows a device 84 for depositing notes, which contains three of the devices 10 described above. The devices 10 are arranged vertically one above the other in such a way that a note 82 can be transferred out of the transport device 76 of the in each case upper device 10 (uppermost in FIG. 6) directly to the supply device of the next lower device 10 (the middle one in FIG. 6). A deposited note 82, which is conveyed into the sheet supply device of the uppermost device 10 by a transport device 86 not specified in any more detail, can subsequently be deposited in a controlled manner in one of six boxes, without a single distributing guide being required. Thus, using the devices 10 described, the device 82 becomes very simple in construction and unsusceptible to faults.

The invention claimed is:

1. A device for stacking sheets, in particular banknotes or check forms, said device comprising:

at least one carrying face for carrying a sheet stack, the carrying face itself or the surface of a sheet stack located on it forming a stack face for depositing the sheets, a roll-on device with a first roller which can be adjusted transversely with respect to its longitudinal axis along an adjustment path which is directed parallel with respect to the stack face, and with at least one first belt which is led from above around the first roller and, parallel with respect to the stack face, to a first fastening point in the region of one end of the adjustment path, at which fastening point said first belt is secured, the stack face being pressed from below against the at least one first belt in order to retain the sheet stack, a sheet supply device which is suitable for transporting a sheet with an edge toward one end of the stack face, from which end it is rolled onto the stack face in the direction of the other end of the latter, wherein the supply device, together with a sheet held in it, can be adjusted along the adjustment path between a first position, in which it can transport the sheet with the edge toward one end of the stack face, and at least one further position, in which it can lead the sheet with the edge toward one end of a further stack face or into a transport device for the further transport of the sheet; and wherein the supply device is formed by a belt transport.

2. The device as claimed in claim 1, wherein the first roller and the supply device are fastened to a carriage or slide moveable along the adjustment path.

3. The device as claimed in claim 1, wherein a plurality of carrying faces, which each form a stack face for sheets, are arranged along the adjustment path.

4. The device as claimed in claim 3, wherein the device comprises a transport device which is arranged between two stack faces and to which a sheet can be transferred from the supply device when the supply device assumes a transfer position contained within the adjustment path.

5. The device as claimed in claim 1, wherein the roll-on device comprises a second roller which is parallel to the first roller and which can be adjusted jointly with the first roller along the adjustment path, in that a roller nip is formed between the first and the second roller, in that the at least one first belt is led, starting from a first belt store, from above through the roller nip and around the first roller, and in that at least one second belt is provided, which, starting from a second belt store, is led from above through the roller nip, around the second roller and, parallel with respect to the stack face, to a second fastening point in the region of the other end of the adjustment path, at which end said second belt is secured.

6. The device as claimed in claim 5, wherein the first and the second belt store are formed in each case by one storage roller, onto which the at least one first or the at least one second belt can be wound.

7. The device as claimed in claim 6, wherein the storage rollers are mounted in each case on a winding shaft, one of the winding shafts is coupled to a drive motor and, via a gear, to the other winding shaft, and the storage rollers are prestressed into their respective winding direction.

8. The device as claim in claim 1, wherein the supply device has a third and a fourth roller, the axis of which is identical to the axis of the first and of the second roller and around which are laid at least one third and at least one fourth belt which form transport belts for the belt transport.

9. The device as claimed in claim 8, wherein the diameter of the third and of the fourth roller is greater than the diameter of the first and of the second roller by at least so much that a sheet transported between the at least one third and the at least one fourth belt through the roller nip between the first and the second roller does not come into contact in the region of the roller nip with the at least one first and the at least one second belt.

10. The device as claimed in claim 8, wherein the third and the fourth roller are mounted fixedly in terms of rotation respectively on a first and a second shaft, and the first and the second roller are mounted freely rotatably respectively on the first and the second shaft.

11. The device as claimed in claim 10, wherein a driving gearwheel is mounted in each case of the first shaft and on the second shaft and is coupled to the respective shaft via a freewheel in such a way that each driving gearwheel can drive the associated shaft in only the direction of rotation which causes a supply of the sheet.

12. The device as claimed in claim 10, wherein a coupling gearwheel is mounted in each case on the first and on the second shaft, said coupling gearwheels being in engagement with one another.

13. The device as claimed in claim 11, wherein a fixed driving gearwheel is provided, which is in engagement with one of the driving gearwheels when the supply device is in the transfer position.

14. The device as claimed in claim 13, wherein the fixed driving gearwheel is coupled to the transport device.

15. The device as claimed in claim 11, wherein at least one rack is arranged along at least part of the adjustment path in such a way that one of the driving gearwheels comes into engagement with said rack when the associated shaft is moved along the adjustment path past the rack.

16. A device for depositing notes, wherein it has a first device and at least one second device as claimed in claim 1, which are arranged in such a way that the transport device of the first device can transfer a banknote to the supply device of the second device.

* * * * *